United States Patent [19]

Simpson, Jr.

[11] Patent Number: 4,503,886

[45] Date of Patent: Mar. 12, 1985

[54] FLOW LIMITING SELECTOR VALVE

[75] Inventor: William E. Simpson, Jr., Chamblee, Ga.

[73] Assignee: Lockheed Corporation, Burbank, Calif.

[21] Appl. No.: 494,084

[22] Filed: May 12, 1983

[51] Int. Cl.[3] ..... F15B 13/04

[52] U.S. Cl. ..... 137/596; 137/596.18

[58] Field of Search ..... 137/596, 596.14, 596.16, 137/596.18, 596.1, 504

[56] References Cited

U.S. PATENT DOCUMENTS

| | | | |
|---|---|---|---|
| 3,910,311 | 10/1975 | Wilke | 91/446 |
| 3,972,267 | 8/1976 | Haak et al. | 137/596.18 |
| 3,980,001 | 9/1976 | Cyphelly | 137/596.18 |
| 4,095,617 | 6/1978 | Hodgson | 137/596.13 |
| 4,117,862 | 10/1978 | Qureshi | 137/625.68 |
| 4,187,877 | 2/1980 | Hodgson et al. | 137/625.68 |
| 4,275,643 | 6/1981 | Knowles | 137/596.1 |

*Primary Examiner*—Henry C. Yuen

*Attorney, Agent, or Firm*—Eric R. Katz

[57] ABSTRACT

A flow limiting, surge damping directional control valve (11) utilizes flow regulating and surge damping means (30) for limiting the rate of flow of an operating fluid in a fluid flow path so as to absorb surge irregularities during the operation of the valve (11). The flow regulating and surge damping means (30) is carried by a movable valve member (25) adapted to control the flow and direction of flow of the operating fluid of the fluid flow path. This arrangement includes a flow regulating piston (35) having metering ports (37) for regulating the rate of flow of the operating fluid across the piston (35) and means (29) for slidably mounting the flow regulating piston on the movable valve member (25) so that the flow regulating piston (35) is positioned adjacent a selected port of the valve (11) during the operation thereof. Biasing means (39) biases the flow regulating piston (35) against the flow of the operating fluid so that when a predetermined pressure drop is experienced across the face of the regulating piston (35), the piston (35) moves against the force of the biasing means (39) in the direction of fluid flow to seal or constrict the selected port until the pressure of the fluid has dropped below the predetermined magnitude.

5 Claims, 7 Drawing Figures

FLOW LIMITING SELECTOR VALVE

TECHNICAL FIELD

This invention generally relates to a valving arrangement for regulating the flow of an operating fluid in a hydraulic circuit and more particularly to an arrangement wherein directional control, speed control and surge damping functions are combined in a single valve.

BACKGROUND ART

In a hydraulic circuit or system of the type concerned here, an operating fluid is pressurized and delivered to a workload, such as a straight-type cylinder, to provide a linear mechanical output and then recirculated. In order to provide an output signal which is a function of an output error signal, selector valves are employed to control the direction of flow of the operating fluid to the workload. These selector valves or hydraulic relays, often take the form of a spool valve, usually constructed in either a three-way or a four-way valve-porting arrangement. The mechanical displacement of the spool allows the hydraulic pressure supply to be ported in a fashion that will displace the work cylinder in either direction, depending upon the spool displacement.

Hydraulic systems are categorized by high power gain inasmuch as liquids can be converted to high pressures or flows through the use of various types of pumps. Thus, the activation of a selector valve often results in flow irregularities and pressure surges or spikes which can cause damaging problems, such as the unintentional activation of control elements as well as line ruptures.

Heretofore, the alleviation of flow irregularities and surge problems have been accomplished by the insertion, into the hydraulic circuit, of separate surge damping valves as well as flow regulators that control the rate of flow of the operating fluid to the workload. While operationally quite efficient, the use of separate selector valves, surge damping valves and flow regulators results in system complexity which increases the cost and weight of the system as well as increasing maintenance requirements while reducing the reliability of the operation.

DISCLOSURE OF THE INVENTION

Accordingly, it is an object of the present invention to provide a mechanism for controlling hydraulic actuation direction and speed while preventing pressure splices or surge.

Another object of the present invention is to provide a mechanism wherein directional control, speed control and surge damping functions are combined into a single valving arrangement.

One advantage of the present invention is that it reduces system complexity by eliminating the necessity for separate valves for directional control, speed control and surge damping functions.

One feature and a significant advantage of the present invention is that it permits the combination of several functions into a single mechanism, thus reducing the number of parts as well as the cost and weight of the system while providing reduced maintenance needs and higher reliability of operation.

In accordance with the principles of the present invention, there is provided a flow limiting, surge damping, directional control valve comprising a valve housing having an inlet port for receiving a supply of pressurized fluid, an outlet port for returning the supply of operating fluid and an utilization port for connecting the control valve to a fluid flow path. Contained within the fluid housing is a movable valve member for controlling the flow and direction of flow of the operating fluid of the fluid flow path. Flow regulating and surge damping means are provided for limiting the rate of flow of the operating fluid of the fluid flow path and for absorbing surge irregularities during the operation of the valve. Also included are means for controlling the position of the movable valve member within the valve housing.

In accordance with the present invention there is also provided a valve mechanism for controlling the direction, pressure and rate of flow of an operating fluid to a hydraulic device, the valve mechanism including a valve housing having an inlet port for receiving a supply of pressurized operating fluid, an outlet port for returning the supply of operating fluid and an utilization port adapted for connection to the hydraulic utilization device. An axially movable valve member is contained in the housing, the valve member being operable in a first position to permit the flow of the pressurized operating fluid from the inlet port to the hydraulic utilization device via the utilization port while simultaneously blocking the outlet port and in a second position to enable the flow of the operating fluids from the hydraulic utilization device via the utilization port to the outlet port while simultaneously blocking the inlet port. A flow regulating and surge damping means is carried by the movable valve member such that in the first position, the flow regulating and surge damping means is positioned adjacent the inlet port and in the second position, is positioned adjacent the outlet port so as to limit the rate of flow of the operating fluid and absorb surge irregularities when the valve member is moved from the first position to the second position and vice versa. Also provided are means for selectively controlling the position of the movable valve member in the first and the second position.

In accordance with the principle of the present invention there is further provided a valve mechanism for controlling the direction, pressure and rate of flow of an operating fluid to a hydraulic utilization device having first and second sides and adapted to be driven in opposite directions. The valve comprises a valve housing having an inlet port for receiving a supply of pressurized fluid, an outlet port for returning the supply of operating fluid and first and second utilization ports adapted for connection to the utilization device on first and second sides thereof, respectively. An axially movable valve member is contained in the housing, this valve member being operable in a first position to block flow from the inlet port to both sides of the hydraulic utilization device while simultaneously permitting return flow, in a second position to enable flow from the inlet port to the first side of the hydraulic utilization device while simultaneously permitting return flow from the second side of the hydraulic utilization device to the outlet port and in a third position to enable flow from the inlet port to the second side of the hydraulic utilization device while simultaneously permitting return flow from the first side to the outlet port. A first flow regulating and surge damping means is positioned adjacent the inlet port for limiting the rate of flow of the operating fluid and for absorbing surge irregularities when the valve member is operated. A second flow limiting and surge damping means is positioned adjacent to the outlet means for limiting the rate of flow of the operating fluid and for absorbing the flow irregularities during the return of the operating fluid. In order to selectively control the position of the movable valve member, a biasing means is included for biasing the movable valve member against the fluid forces from the supply of pressurized operating fluid to provide a function for controlling the position of the movable valve member between the first position and the second and third positions.

In accordance with present invention, the flow regulating and surge damping means includes a flow regulating piston having symetrically located metering ports for regulating the rate of flow of the operating fluid across the piston. Means are provided for slidably mounting the flow regulating piston on the movable valve member so that the flow regulating piston is positioned adjacent the edge of a selected valve port during the operation of the valve. A biasing means biases the flow regulating piston against the flow of the operating fluid during the operation of the valve so that during the occurrence of a pressure pulse having a value greater than a predetermined magnitude, the pressure drop across the flow regulating piston overcomes the biasing means of the piston thus moving the piston to seal the selected port until the pressure drop across the piston has dropped below the predetermined magnitude.

BRIEF DESCRIPTION OF THE DRAWINGS

The foregoing and other objects, features, and advantages of the invention will be apparent from the following more particular description of the preferred embodiment of the invention, as illustrated in the accompanying drawings in which like reference characters refer to the same ports throughout different views. The drawings are not necessarily to scale, emphasis being placed upon illustrating the principles of the invention.

BEST MODE FOR CARRYING OUT THE INVENTION

Figure 1A:
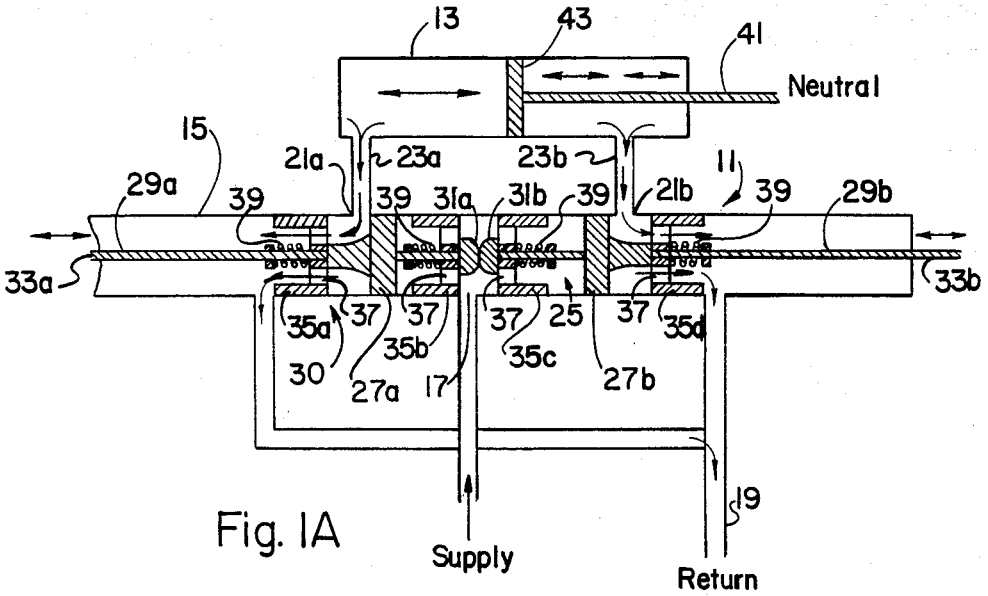
FIGS. 1A–1C schematically illustrate the operation of the flow limiting valve in accordance with the present invention.

Referring to FIG. 1A, the selector valve of the present invention is generally illustrated at 11 and is adapted to control the direction, pressure and rate of flow of an operating fluid to a hydraulic utilization device such as a straight-type cylinder 13. The valve mechanism 11 includes a valve housing 15 having an inlet port 17 for receiving a supply of pressurized operating fluid and an outlet port 19 for returning the supply of operating fluid. The valve housing 15 is also provided with utilization ports 21*a* and 21*b* adapted to convey the operating fluid to and from the hydraulic cylinder 13 depending upon a configuration of the valve 11.

A movable valve member, generally indicated at 25, is contained in the housing 15 for controlling the flow and direction of flow of the operating fluid of flow paths 23*a* and 23*b*. In the embodiment illustrated, the valve member 25 is a spool valve, the mechanical displacement of spools 27A, 27B allowing the hydraulic pressure supply to be ported in a fashion that will displace the hydraulic cylinder 13 in either direction depending on the position of the spools. Each spool 27A, 27B is mounted on a slide element 29A, 29B, respectively. The slide elements 29A, 29B are adapted to independently control the position of the spools 27A, 27B within the housing 15. Distal ends 31A, 31B of the slide elements 29A, 29B, respectively, are bulbous in nature and adapted to abut one another as illustrated in FIG. 1A. Each proximal end 33A, 33B of the slide elements 29A, 29B, respectively, is adapted to be connected to a mechanical means (not shown) for independently positioning the slide elements 29A, 29B in housing 15. The mechanical means can be a servo-mechanism of an electric, pneumatic or hydraulic nature although pilot pistons are preferred.

Slidably mounted for easy reciprocating axial movement on elements 29A and 29B is a flow regulating and surge damping means generally indicated at 30 and comprising flow regulating pistons 35A, 35B and 35C, 35D, respectively. Each flow regulating piston 35 is provided with symetrically located metering ports 37 for regulating the rate of flow of the operating fluid across the piston 35. The circumferential surface of each piston 35 abuts the inner surface of the valve housing to form a seal so that the operating fluid is directed through the metering ports 37. A biasing means 39 is provided for biasing the flow regulating piston against the flow of the operating fluid. In the embodiment illustrated the biasing means comprises coil springs, however, any other suitable biasing means can be employed.

Each piston 35 is mounted on the valve member 25 so as to be positioned adjacent the edge of a selected port during the operation of the valve. The biasing means 39 and metering ports 37 are related to one another or calibrated such that the flow is limited to a predetermined rate and pressure magnitude as will be more fully understood as the description of the operation of the valve is provided hereinafter.

Figure 1B:
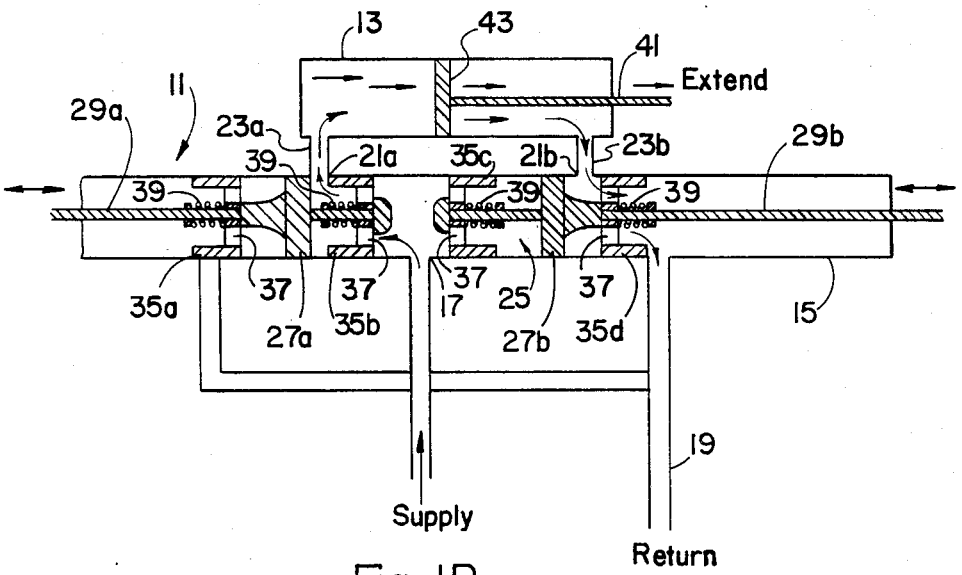
Figure 1C:
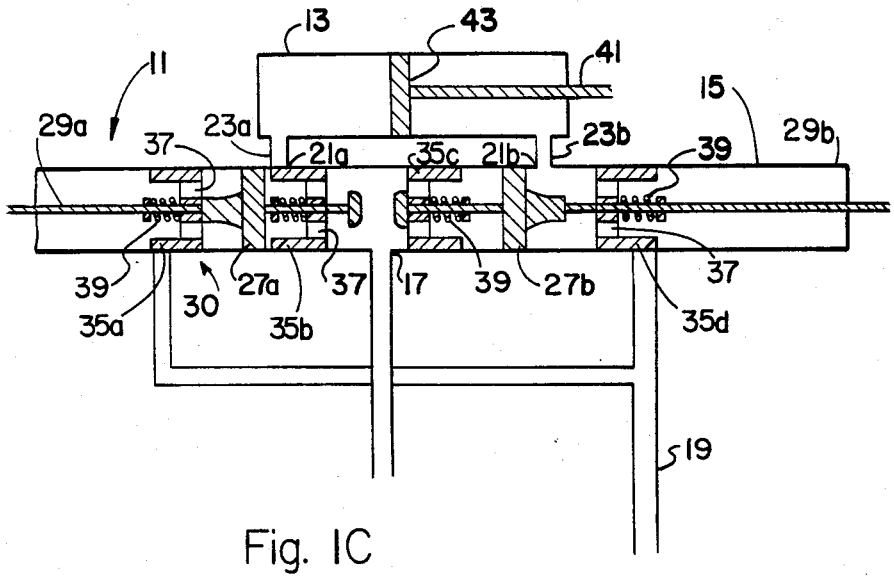

The operation of the selector valve 11 is best understood with reference to FIGS. 1A–1C which depict the sequential operation of the invention. As seen in FIG. 1A, the valve 11 is in a closed position, however, fluid paths 23 are in communication with outlet port 19 via metering ports 37 of the regulating pistons 35A and 35D. In order to extend the piston rod 41 of the straight-type cylinder 13, the slide element 29A is retracted so that spool 27A is positioned adjacent but behind the utilization port 21A. This establishes a fluid flow path from the inlet port 17 through metering port 37 of flow regulating piston 34B to utilization port 21A such that a supply of pressurized operating fluid impinges on one side of piston 43. As illustrated in FIG. 1B, flow regulating piston 35B is positioned adjacent the edge of utilization port 21A, however, the flow regulating piston 35B does not seal this port. Concurrently, a return flow path is established from the opposite side of piston 43 via fluid flow path 23 through the metering port 37 of flow regulating piston 35D to the outlet port 19 so that the work fluid may be returned and piston rod 41 extended. As illustrated, the flow regulating piston 35D is positioned adjacent the edge of outlet port 19, however, it does not seal this port.

Because the operating fluid is under pressure, a pressure surge or spike is generated each time the valve 11 is opened or closed. In order to snub this pressure surge and regulate the speed of response of the hydraulic utilization device, it is necessary to regulate the pressure and rate of flow of the utilization fluid. This function is achieved by the flow regulating and surge damping means generally indicated at 30 which limits the rate of flow of the operating fluid by means of metering ports 37 and absorbs surge irregularities as will be described hereinafter with particular reference to FIG. 1C.

As the operating fluid goes through the metering ports 37 to pressure regulating piston 35B, a pressure drop is experienced across the face of the piston 35B. If the pressure drop is above a predetermined limit, it causes the piston 35B to move in the direction of the fluid flow against biasing means 39 to thereby constrict or seal the utilization port 21A as illustrated in FIG. 1C. This limits the flow of operating fluid from the inlet port 17 to the utilization port 21A such that the pressure surge is snubbed. Once the pressure across the face of the piston 35B has dropped below a predetermined limit, flow is reestablished as the piston 35B moves counter to the direction of fluid flow by means of biasing means 39. Subsequent flow is limited to the rate determined by the metering port size and biasing force of biasing means 39.

Concurrently, return flow from the cylinder 13 to the outlet port 19 is similarly regulated. The utilization fluid passes through the metering ports 37 of flow regulating piston 35D thus causing a pressure drop across the face of the piston 35D. If the pressure drop is above a predetermined limit determined by the metering port size and spring calibration, the piston 35D moves in the direction of fluid flow against the force of biasing means 39 to constrict outlet port 19 so that the pressure surge is snubbed. Once the pressure has dropped below the predetermined limit, flow is reestablished as the piston 35D moves against the fluid flow by means of biasing means 39. Subsequent flow is limited to the rate determined by the metering port size and biasing force.

When slide element 29A is moved from the position illustrated in FIGS. 1B and C to the configuration illustrated in 1A, flow to the hydraulic cylinder 13 ceases. The energy stored in the hydraulic circuit that has been pressurized drives fluid through the metering ports 37 of flow regulating pistons 35A and 35D causing a pressure drop across the face of these pistons so that each piston 35 moves against biasing means 39 thereby absorbing the pressure surge which results when the valve mechanism 11 is shut off.

In order to retract piston rod 41, slide element 29B would be moved so that spool 27B allows the establishment of a fluid flow path from inlet port 17 via utilization port 21B to the opposite side of the piston. The operation of the flow regulating and surge damping means 30 of the present invention is similar to that described hereinabove. Thus, valve 11 provides flow limiting and surge damping functions as well as directional control.

Figure 2:
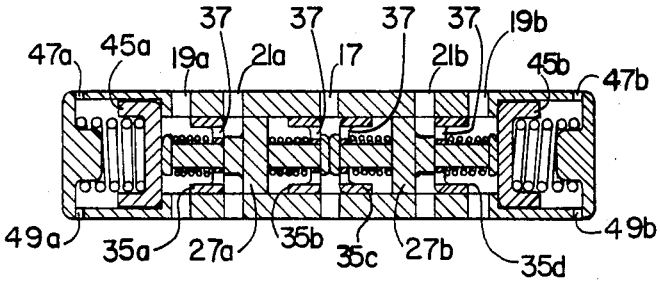
FIG. 2 illustrates a hydraulic pilot operated four-way, three-position flow limiting selector valve in accordance with the present invention.

Referring to FIG. 2, an alternative embodiment of the present invention is illustrated utilizing pilot pistons 45A and 45B to control the displacement of slide elements 29A and 29B, respectively. In this particular embodiment, system pressure is normally applied to pilot ports 47A and 47B as well as inlet port 17 so that the larger areas of the two pilot pistons 45A, 45B cause them to overcome the two selector valve spools 27A and 27B and hold these spools 27A and 27B in the neutral position as illustrated.

When either pilot pressure is dumped by actuation of a conventional pilot valve (not shown), the force output of the affected pilot piston drops so that the adjacent selector valve spool overcomes the spring bias means 49A or 49B, so as to move the associated spool 27 and connect system pressure from inlet port 17 to the associated utilization port 21. As previously described, the quick-opening pressure surge to the utilization port 21 is snubbed by the flow regulating piston 35 that is carried by the motion of the selector valve spool 27 to the edge of the selected valve port. Flow through the metering ports 37 of the flow regulating piston 35 causes a pressure drop which moves the piston 37 against its biasing means 39 to limit the flow from the inlet port to the associated utilization port thus absorbing the resulting pressure spike and limiting the subsequent flow to the rate determined by the spring/metering port calibration.

When the conventional pilot valve (not shown) is deactivated, pilot pressure is restored to the associated pilot piston 45, causing it to push the adjacent selector valve spool 27 to the neutral position, blocking system pressure to the utilization ports 21 which are then connected to outlet ports 19. As previously described, the energy stored in the circuit that has been pressurized by the inlet port drives fluid through the metering ports 37 in the adjacent flow regulating pistons 35 thus causing the flow regulating piston 35 to move against the associated biasing means to absorb the resulting pressure surge.

Figure 3:
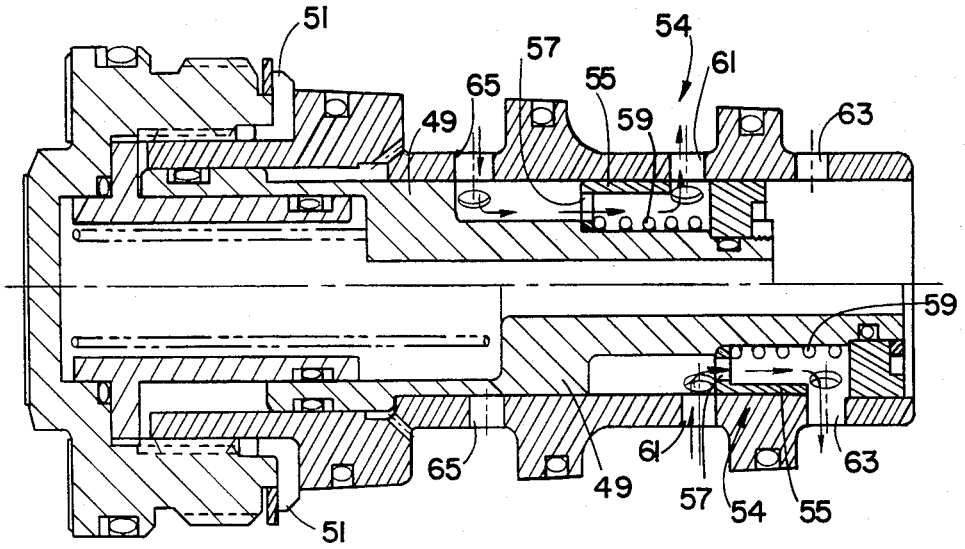
FIG. 3 is a composite view illustrating a three-way, two-position flow limiting selector valve cartridge shown in the open position.

FIG. 3 illustrates yet another embodiment of the present invention which comprises a three-way, two-position flow limiting selector valve cartridge which is normally operated in the closed position. In this particular embodiment, the movable valve member comprises a slide 49, the position of which is controlled by means of system control pressure applied to control port 51. Slide 49 is provided with a channel 53 adapted to slidably carry a flow regulating and surge damping means 54 including flow regulating piston 55 so as to position the piston 55 adjacent a selected valve port depending upon the operation of the valve. Flow regulating piston 55 is provided with metering ports 57 and is biased by means of spring 59 or the like in a direction counter to the normal flow of the operating fluid. In the closed position illustrated by the bottom half of FIG. 3, flow is established between cylinder port 61 and return port 63, the flow regulating and surge damping means 54 functioning in a manner similar to that described hereinabove. When the slide 49 is moved to the left as shown by the top portion of FIG. 3, system pressure is established between inlet port 65 and cylinder port 61 while return port 63 is blocked, flow regulating and surge damping means 54 being positioned adjacent to the edge of cylinder port 61.

Figure 4:
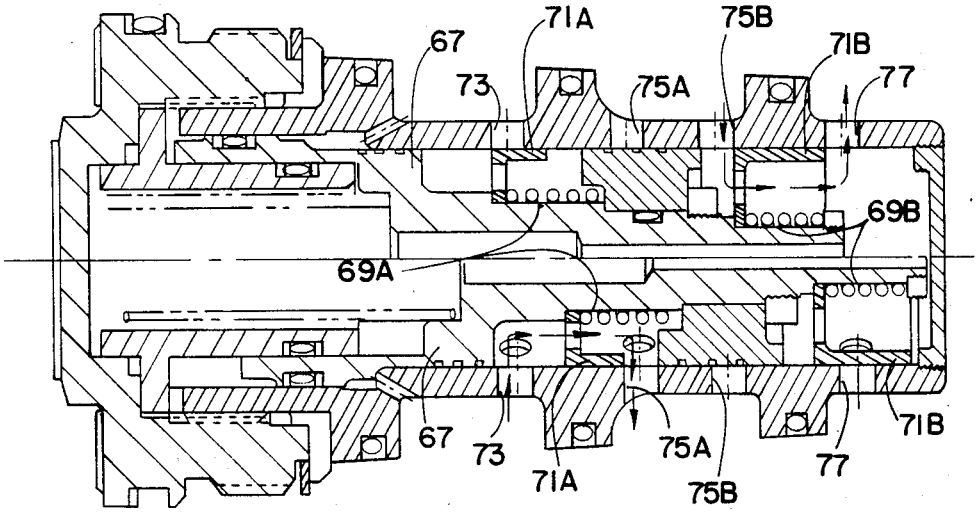
FIG. 4 is a composite view illustrating a three-way, two-position flow limiting selector valve cartridge in the closed position.

FIG. 4 illustrates yet another embodiment of the present invention, which is a three-way, two-position flow limiting selector valve cartridge adapted to be normally operated in the open position. As in the embodiment illustrated by FIG. 3, the valve employs a slide 67, however, the slide 67 had channels 69A and 69B which are each adapted to carry flow limiting and surge damping means 71A, 71B, respectively. As shown by the bottom half of FIG. 4, a fluid flow path is established between inlet port 73 and cylinder port 75A, flow limiting and surge damping means 71A functioning as previously described. In this position, the flow limiting and surge damping means 71B is positioned on slide 67 so as to block return port 77. When the slide is moved to the left, as illustrated by the top portion of FIG. 4, a fluid flow path is established between cylinder port 75B and return port 77 while flow limiting and surge damping means 71A blocks inlet port 73. The flow limiting and surge damping means 71 function in a manner as previously described.

Figure 5:
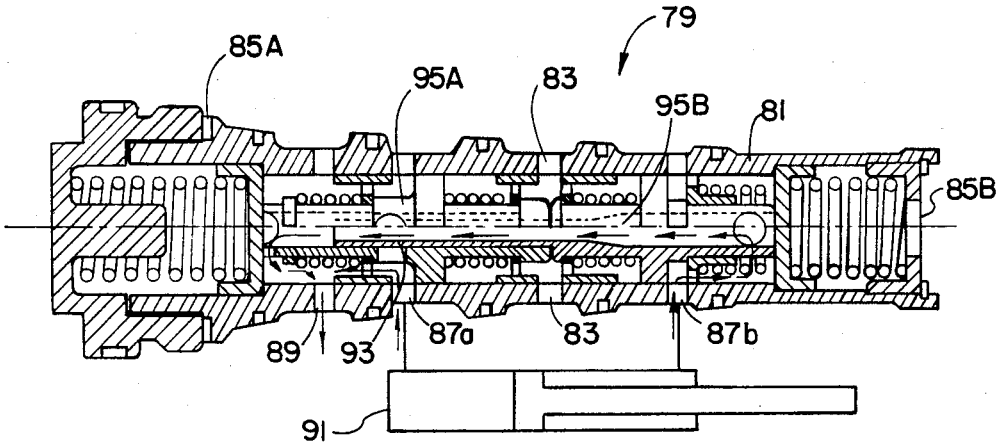
FIG. 5 illustrates a hydraulic pilot operated four-way, three-position flow limiting selector valve step tapered cartridge.

FIG. 5 illustrates a hydraulic pilot operated four-way, three-position flow limiting selector valve, generally indicated at 79, wherein a single return port is provided. In this embodiment of the present invention, the valve 79 is in the form of a tapered cartridge 81 including an inlet port 83 and pilot pressure port 85A, 85B to which system pressure is applied in a manner similar to the embodiment illustrated by FIG. 2. Also, provided are cylinder ports 87A, 87B and a single return port 89.

A hydraulic cylinder 91 is operatively associated, for example, with the valve 79 via cylinder ports 87A, 87B and as illustrated is the neutral position with both cylinder ports 87A, 87B connected to the return port 89. The valve 79 functions in a manner similar to the embodiment of FIG. 2, however, differs in that only a single return port is provided. This single return port arrangement is accomplished by means of a sleeve conduit 93 which provides a fluid flow path from cylinder port 87B to the return port 89 through slide element 95, 95B, cylinder port 87A being connected to the return port 89.

While the invention has been particularly shown and described with reference to preferred embodiments thereof, it will be understood by those skilled in the art that various alterations in form and detail will be made therein without departing from the spirit and scope of the invention.

I claim:

1. A flow limiting, surge damping directional control valve comprising:

(a) a valve housing having an inlet port for receiving a supply of pressurized operating fluid, an outlet port for returning the supply of operating fluid and a utilization port for connection to a fluid flow path;

(b) a movable valve member contained in said housing for controlling the flow and direction of flow of the operating fluid of the flow path;

(c) flow regulating and surge damping means for limiting the rate of flow of the operating fluid of the fluid flow path by constricting a selected valve port and for absorbing surge irregularities during the operation of said valve by sealing said selected valve port; and (d) means for positioning said movable member in said valve housing for controlling the direction of flow of the operating fluid of the fluid flow path.

2. The valve of claim 1 wherein said flow regulating and surge damping means comprises:

(a) a flow regulating piston having a metering port for regulating the flow of the operating fluid across said piston and for generating a pressure differential across said piston;

(b) means for slidably mounting said flow regulating piston on said movable valve member such that said flow regulating piston is positioned adjacent a selected port during the operation thereof; and (c) biasing means for biasing said flow regulating piston against the flow of the operating fluid, said biasing means being calibrated with said metering port of said flow regulating piston to regulate the rate of flow of the operating fluid when said pressure differential across said flow regulating piston exceeds a predetermined limit causing said flow regulating piston to move against the force of said biasing means in the direction of flow of the operating fluid and constrict said selected port and to seal said selected port during momentary pressure surges.

3. A flow limiting, surge damping, directional control valve according to claim 1, for use with a hydraulic device adapted for connecting to said utilization port of said valve housing wherein:

said movable valve member contained in said housing is operable in a first position to permit the flow of pressurized operation fluid from said inlet port to the hydraulic utilization device via said utilization port while simultaneously blocking said outlet port and in a second position to enable the flow of the operating fluid from the hydraulic utilization device via said utilization port to said outlet port while simultaneously blocking said inlet port; and said flow regulating and surge damping means is carried by said movable valve member such that in the first position, said flow regulating and surge damping means is positioned adjacent said inlet port and in the second position, it is positioned adjacent said outlet port to regulate the pressure, and rate of flow of the operating fluid to the hydraulic utilization device during the operation of said valve mechanism.

4. A valve mechanism for controlling the pressure, direction and rate of flow of an operating fluid to a hydraulic utilization device having first and second sides and adapted to be driven in opposite directions, said valve mechanism comprising:

(a) a valve housing having an inlet port for receiving a supply of pressurized operating fluid, an outlet port for returning the supply of operating fluid and first and second passages adapted for connection to the utilization device on first and second sides thereof, respectively;

(b) an axially movable valve member contained in said housing, said valve member being operable in a first position to block the flow of the pressurized operating fluid from said inlet port to both sides of the hydraulic utilization device while simultaneously permitting return flow therefrom, in a second position to enable flow from said inlet port to the first side of the hydraulic utilization device while simultaneously permitting return flow from the second side of the hydraulic utilization device to the outlet port and in a third position to enable flow from said inlet port to the second side of the hydraulic utilization device while simultaneously permitting return flow from the first side of the hydraulic utilization device to said outlet port;

(c) first flow regulating and surge damping means for limiting the rate of flow of the operating fluid by constricting a selected valve port and for absorbing surge irregularities during the operation of said mechanism by sealing said selected valve port, said first flow regulating and surge damping means being positioned adjacent said inlet port during the operation of said valve mechanism;

(d) second flow regulating and surge damping means for limiting the rate of flow of the operating fluid by constricting a selected valve port and for absorbing surge irregularities during the operation of said valve mechanism by sealing said selected port, said second flow regulating and surge damping means positioned adjacent said outlet port during operation of said valve mechanism; and (e) means for positioning said movable valve member contained in said housing so as to control the direction of flow of said operating fluid to said hydraulic utilization device.

5. The valve of claim 4 wherein said first and second flow regulating and surge damping means each comprise:

(a) a flow regulating piston having a metering port for regulating the flow of the operating fluid across said piston and for generating a pressure differential across said piston;

(b) means for slidably mounting said flow regulating piston on said movable valve member such that said flow regulating piston is positioned adjacent a selected valve port during the operation thereof; and (c) biasing means for biasing said flow regulating piston against the flow of the operating fluid, said biasing means being calibrated with said metering port of said flow regulating piston to regulate the rate of flow of the operating fluid when said pressure differential across said flow regulating piston exceeds a predetermined limit causing said flow regulating piston to move against the force of said biasing means in the direction of flow of the operating fluid and constrict said selected port and to seal said selected port during momentary pressure surges.

* * * * *